US005278127A

United States Patent [19]

Dombrowski et al.

[11] Patent Number: 5,278,127

[45] Date of Patent: Jan. 11, 1994

[54] TRANSPARENT THERMOGRAPHIC RECORDING FILMS

[75] Inventors: Edward J. Dombrowski, Bellingham; John R. McPherson, Sr., West Newton, both of Mass.

[73] Assignee: Polaroid Corporation, Cambridge, Mass.

[21] Appl. No.: 9,829

[22] Filed: Jan. 27, 1993

[51] Int. Cl.[5] ..... B41M 5/32

[52] U.S. Cl. ..... 503/207; 503/200; 503/210; 503/214; 503/217; 503/220; 503/224; 503/226

[58] Field of Search ..... 503/200, 207, 210, 214, 503/217, 220, 224, 226

[56] References Cited

U.S. PATENT DOCUMENTS

| | | | |
|---|---|---|---|
| 2,956,958 | 10/1960 | Ller | 252/313 |
| 4,583,103 | 4/1986 | Hayashi et al. | 346/209 |
| 4,820,682 | 4/1989 | Shimomura et al. | 503/207 |
| 4,904,572 | 2/1990 | Dombrowski, Jr. et al. | 430/332 |
| 4,985,394 | 1/1991 | Mori et al. | 503/226 |
| 5,198,406 | 3/1993 | Mack et al. | 503/226 |

FOREIGN PATENT DOCUMENTS

| | | | |
|---|---|---|---|
| 250558 | 2/1990 | European Pat. Off. | 503/200 |
| 2210702 | 6/1989 | United Kingdom | 503/200 |

OTHER PUBLICATIONS

Ller, R. K., The Chemistry of Silica, John Wiley & Sons, NY, 1979, pp. 369–372.

*Primary Examiner*—Pamela R. Schwartz
*Attorney, Agent, or Firm*—Carol A. Loeschorn

[57] ABSTRACT

This invention relates to the use of a compound containing at least two epoxide moieties in the protective topcoat layer and/or in a layer on top of the protective topcoat layer of certain thermographic recording films to reduce gouging and streaking of the printed image film and to reduce head build-up on the thermal printhead.

28 Claims, No Drawings

TRANSPARENT THERMOGRAPHIC RECORDING FILMS

BACKGROUND OF THE INVENTION

The present invention relates to thermographic recording films, and more specifically, it relates to the use of a crosslinking compound containing at least two epoxide moieties in a topcoat layer and/or in a layer on top of the topcoat layer of certain thermographic recording films which are to be imaged with a thermal printhead. The crosslinking compound helps to prevent gouging, to reduce head build-up on the thermal printhead, enhance print performance and to improve the image quality of the printed image.

(2) Description of the Related Art

Color-forming di- and triarylmethane compounds possessing certain S-containing ring closing moieties, namely a thiolactone, dithiolactone or thioether ring closing moiety are disclosed in European Patent No. 250,558 and U.S. Pat. No. 5,196,297 of E. J. Dombrowski, Jr. et al. These dye precursors undergo coloration by contacting with a Lewis acid material, preferably a metal ion of a heavy metal, particularly silver, capable of opening the S-containing ring moiety to form a colored metal complex.

As disclosed in the above-cited patents, the ability of these dye precursors to form a colored dye almost instantaneously when contacted with $Ag+$ renders them eminently suitable for use as color formers in thermal imaging systems employing organic silver salts, such as silver behenate. In these systems, color formation is particularly efficient since it is effected by a phase change, i.e., effected by the melting of the organic silver salt to provide the $Ag+$ necessary for coloration rather than requiring a change of state.

These thermographic recording films preferably include a heat-fusible organic acid material. U.S. Pat. No. 4,904,572 of E. J. Dombrowski, Jr. et al, issued Feb. 27, 1990, discloses 3,5-dihydroxybenzoic acid as a preferred heat-fusible organic acid.

The above described thermal color-forming system preferably employs a thermoplastic binder, e.g. polyvinylbutyral. When imagewise heating is accomplished by means of a thermal printhead, the thermoplastic binder is in direct contact with the thermal printhead during imaging. Since thermoplastic binders soften upon the application of heat, they tend to stick to the thermal printhead during imaging. This "sticking" interferes with the printing, adversely affects image quality, and can cause damage to the printhead.

A number of ways to prevent sticking between a binder and a thermal printhead during printing have been suggested for various thermographic recording films. Many of these employ a protective or anti-stick topcoat comprising silica over the thermographic color-forming layer. These topcoats contact the thermal printhead during imaging to prevent "sticking". Another way to prevent sticking has been to employ a surface active agent to add anti-stick properties. However, these silica containing topcoats and surface-active agents have drawbacks and/or do not perform adequately when the binder employed in the coloring system is polyvinylbutyral and the support used for the thermosensitive recording film is a transparent support.

For example, low surface energy materials such as silicone polymers exhibit good anti-stick properties. However, the useful silicone polymers are relatively low molecular weight silicone polymers which have a tendency to be migratory and thus cause problems, e.g., they transfer to the back of the film if it is rolled for storage or to the back of the adjacent film if stored in sheets. In addition, because these silicones are polymers, their properties change with changes in moisture and temperature and therefore, their performance is not consistent under all conditions.

U.S. Pat. No. 4,583,103 issued Apr. 15, 1986 and U.S. Pat. No. 4,820,682 issued Apr. 11, 1989 disclose protective topcoats for heat-sensitive recording papers containing a binder comprising silicon modified polyvinylalcohol and colloidal silica and/or amorphous silica. The above patents also disclose topcoats wherein said colloidal silica contains silica grains having an average particle size of from about 10 millimicrons (mμ) to 100 mμ (1 mμ = 1 nanometer (nm)) and the amorphous silica has primary grain size of about 10 micrometers (μm) to 30 μm (1 μm = $10^3$ nm). These topcoats are disclosed as providing good printing densities, resistance to various chemicals, oils and water, and anti-sticking and anti-blocking properties. In addition, the latter patent discloses the topcoat as exhibiting excellent transparency and describes it for use on a transparent base. However, the lowest level of haze reported is 16%, a level which is higher than desirable for overhead transparency (OHT) applications.

Published UK Patent Application No. 2,210,702 having a publication date of Jun. 14, 1989 and assigned to the same assignee as the latter two patents, discloses a heat-sensitive recording material which, when it employs a topcoat as described above, e.g., silicon modified polyvinylalcohol and colloidal silica, reports a level of haze as low as 8%.

However, when polyvinylbutyral is used as the binder for the color-forming materials of this invention, and a topcoat as described above, i.e. silicon modified polyvinylalcohol and colloidal silica, is employed to prevent sticking, there is poor adhesion between the topcoat and underlying polyvinylbutyral layer, as well as poor scratch resistance of the resulting film. In addition, the silicon modified polyvinyl alcohol binder is water soluble and can be rubbed off with water.

U.S. Pat. No. 4,985,394 issued Jan. 15, 1991 discloses a topcoat for a thermosensitive recording material which comprises at least one inorganic pigment selected from the group consisting of silica and calcium carbonate, each having an average particle diameter of 0.1 μm or less, and a water-soluble binder, formed on the thermosensitive coloring layer. Many of these topcoats have problems of inadequate transparency and/or adhesion when coated over the polyvinylbutyral color-forming layer of the present invention.

The commonly assigned U.S. Pat. No. 5,198,406 of J. M. Mack and K. Sun, discloses a topcoat for transparent thermographic recording films using the above color-forming system. Specifically, the transparent thermographic recording films described therein comprises a transparent support carrying:

(a) a dye image-forming system comprising a di- or triarylmethane thiolactone dye precursor, an organic silver salt, a heat-fusible organic acidic material, and polyvinylbutyral as the binder; and, (b) a protective topcoat layer positioned above said dye image-forming system and comprising a water-insoluble polymeric binder, a mixture of at least two colloidal silicas having different average particle diameters in the proportion, by weight, of 1 part of silica having an average diameter of 50 nm or smaller and 0.3 to 1 part of silica particles having an average diameter no more than 40% of the larger sized silica particles, the ratio of total silica to binder being at least 3 parts per weight silica to 1 part per weight binder.

While the above described topcoat prevents sticking of the polyvinylbutyral color-forming layer(s) to the thermal printhead during printing, with certain high energy thermal printers, e.g. Model BX 500 high density printer, commercially available from Seikosha America, Inc., Mahwah, N.J. and Model TDU 850 commercially available from Raytheon Company, Submarine Signal Division, Portsmouth, R.I., there are the problems of gouging on the surface of the recording film and head build-up on the thermal printer.

"Gouging" results in actual depressions or indentations in the recording film which can be either continuous or intermittent. Gouging is believed to be caused by high temperatures, pressure and/or sticking.

"Head build-up" is the build-up of components of the thermographic recording film on the thermal printhead. Head build-up can cause streaking in the printed image, decreased image density with continued printing and damage to the thermal printhead. Head build-up can become so pronounced, particularly when a lubricant, e.g. polytetrafluoroethylene, is present in the topcoat, that it appears as "spiderwebs" on the thermal printer.

"Streaking" is believed to be the result of the insulating effect of head build-up on the printing element(s) of the thermal printhead which interferes with printing causing linear discoloration ("streaking") in the printed image.

The presence of a lubricant in the topcoat is generally desired to impart slip characteristics and to decrease gouging of the printed image, however, head build-up usually becomes more pronounced when a lubricant, e.g. polytetrafluoroethylene, is used in the topcoat. Generally, the greater the concentration of lubricant, the greater the degree of head build-up.

The aforementioned copending U.S. Pat. No. 5,198,406 of J. M. Mack et al., discloses the use of organofunctional silanes in the topcoat or in a layer on top of the topcoat to react with both the silica and the binder(s) in the topcoat thereby functioning as a coupling agent to join the two and thereby reinforce and strengthen the silica/polymeric binder matrix. The addition of the organofunctional silane helps to reduce head build-up and improves the scratch resistance of the recorded image.

SUMMARY OF THE INVENTION

The present invention is concerned with the addition of a compound containing at least two epoxide moieties in the protective topcoat layer and/or in a layer on top of the protective topcoat layer of a thermographic recording film to strengthen and reinforce the thermographic recording film and to thereby reduce gouging and head build-up, enhance print performance by decreasing density degradation and improve image quality by decreasing streaking.

It is, therefore, among the objects of the present invention to provide thermographic recording materials.

DETAILED DESCRIPTION OF THE INVENTION

The thermographic recording films according to this invention comprise a support carrying:

(a) a dye image-forming system comprising a di- or triarylmethane thiolactone dye precursor, an organic silver salt, a heat-fusible organic acidic material, and a polymeric binder; and, (b) a protective topcoat layer positioned above said dye image-forming system and comprising a mixture of at least two colloidal silicas having different average particle diameters in the proportion, by weight, of 1 part of silica having an average diameter of 50 nm or smaller and 0.3 to 2.0 parts of silica particles having an average diameter no more than 40% of the larger sized silica particles, said thermographic recording film additionally including a compound containing at least two epoxide moieties in the protective topcoat layer and/or in a layer on top of said protective topcoat layer, the ratio of total silica to said compound containing at least two epoxide moieties being at least 2.0 parts per weight silica to 1 part per weight compound containing at least two epoxide moieties. Preferably, the topcoat layer also includes a binder in which case the ratio of total silica to compound containing at least two epoxide moieties and binder combined is at least 2 parts per weight silica to 1 part per weight compound containing at least two epoxide moieties and binder combined.

The absence of a binder in the topcoat generally results in higher levels of haze.

The transparent supports that can be used in the present invention may be comprised of various materials and numerous suitable support substrates are known in the art and are commercially available. Examples of materials suitable for use as support substrates include polyesters, polycarbonates, polystyrenes, polyolefins, cellulose esters, polysulfones and polyimides. Specific examples include polypropylene, cellulose acetate, and most preferably, polyethylene terephthalate. The thickness of the support substrate is not particularly restricted, but should generally be in the range of about 2 to 10 mils. The support substrate may be pretreated to enhance adhesion of the polymeric coating thereto.

The thermographic recording films of the present invention may employ a reflective support in place of the transparent support.

The di- and triarylmethane thiolactone compounds used as the dye precursors in the present invention may be any of those described in the aforementioned European Patent No. 250,558 and U.S. Pat. No. (Ser. No. 06/935,534) of E. J. Dombrowski, Jr. et al. The dye precursors may be represented by the formula

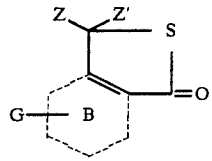

wherein ring B represents a substituted or unsubstituted carbocyclic aryl ring or rings, e.g., of the benzene or naphthalene series or a heterocyclic ring, e.g., pyridine or pyrimidine; G is hydrogen or a monovalent radical; and Z and Z' taken individually represent the moieties to complete the auxochromophoric system of a diarylmethane or a triarylmethane dye when said S-containing ring is open and Z and Z' taken together represent the bridged moieties to complete the auxochromophoric system of a bridged triarylmethane dye when said S-containing ring is open, i.e., when the ring sulfur atom is not bonded to the meso carbon atom. Usually, at least one of Z and Z' whether taken individually or together possesses as an auxochromic substituent, a nitrogen, oxygen or sulfur atom or a group of atoms containing nitrogen, oxygen or sulfur.

In a preferred embodiment, B is a benzene ring and Z and Z' taken individually or together complete the auxochromophoric system of a triarylmethane dye.

The dye precursor compounds used in the present invention can be monomeric or polymeric compounds. Suitable polymeric compounds are those which, for example, comprise a polymeric backbone chain having dye precursor moieties attached directly thereto or through pendant linking groups. Polymeric compounds of the invention can be provided by attachment of the dye precursor moiety to the polymeric chain via the Z and/or Z' moieties or the ring B. For example, a monomeric dye precursor compound having a reactable substituent group, such as an hydroxyl or amino group, can be conveniently reacted with a monoethylenically unsaturated, polymerizable compound having a functional and derivatizable moiety, to provide a polymerizable monomer having a pendant dye precursor moiety. Suitable monoethylenically unsaturated compounds for this purpose include acrylyl chloride, methacrylyl chloride, methacrylic anhydride, 2-isocyanatoethyl methacrylate and 2-hydroxyethyl acrylate, which can be reacted with an appropriately substituted dye precursor compound for production of a polymerizable monomer which in turn can be polymerized in known manner to provide a polymer having the dye precursor compound pendant from the backbone chain thereof.

The thiolactone dye precursors can be synthesized, for example, from the corresponding lactones by heating substantially equimolar amounts of the lactone and phosphorus pentasulfide or its equivalent in a suitable solvent. The silver behenate may be prepared in a conventional manner using any of various procedures well known in the art.

The polymeric binder for use in the dye-imaging forming system may be any of those binders described in the aforementioned European Patent No 250,558 and the aforementioned U.S. Pat. No. 5,196,297 of E. J. Dombrowski, Jr. et al. The preferred polymeric binder is polyvinylbutyral.

The organic silver salts which can be employed in the color-forming system of the present invention include any of those described in the aforementioned European Patent No. 250,558 and U.S. Pat. No. 5,196,297 of E. J. Dombrowski, Jr. et al. Preferred silver salts are the silver salts of long chain aliphatic carboxylic acids, particularly silver behenate which may be used in admixture with other organic silver salts if desired. Also, behenic acid may be used in combination with the silver behenate.

The preparation of such organic silver salts is generally carried out by processes which comprise mixing a silver salt forming organic compound dispersed or dissolved in a suitable liquid with an aqueous solution of a silver salt such as silver nitrate or a silver complex salt. Various procedures for preparing the organic silver salts are described in U.S. Pat. Nos. 3,458,544, 4,028,129 and 4,273,723.

The heat-fusible organic acidic material which can be employed in this invention is usually a phenol or an organic carboxylic acid, particularly a hydroxy-substituted aromatic carboxylic acid, and is preferably 3,5-dihydroxybenzoic acid. A single heat-fusible organic acid can be employed or a combination of two or more may be used.

One of the colloidal silicas employed in the topcoats of the present invention may be a fumed colloidal silica. Fumed colloidal silica is branched, three-dimensional, chain-like agglomerates of silicon dioxide. The agglomerates are composed of many primary particles which have fused together. Fumed silica is produced by the hydrolysis of silicon tetrachloride vapor in a flame of hydrogen and oxygen. The fumed colloidal silica is referred to as "fumed" silica because of its smoke-like appearance as it is formed. If fumed colloidal silica is employed, an average particle diameter in the range of 14–30 nm is generally used, preferably 14–15 nm.

Silicas having an average diameter of 50 nm or less are required to be used in the topcoats of the present invention. Employing silicas having an average diameter in excess of 50 nm results in inferior transparent thermographic recording films having higher levels of haze and hence films which are not as transparent. For overhead transparency (OHT) applications, it is desired that the thermographic recording films have a measured level of haze less than 10%, and preferably less than 5%. It is preferred that the largest sized colloidal silica employed in the present invention be at least 20 nm in diameter, unless fumed colloidal silica is used as the largest sized silica in which case, it is preferred that the fumed colloidal silica be at least 14 nm in diameter.

The mixture of silicas is required to give the hardness and durability necessary to prevent sticking of the polyvinylbutyral to the thermal printhead, to inhibit scratching on the surface of the thermographic recording film and to limit crazing, i.e., cracking on the surface of the film. As mentioned above, a mixture of at least two colloidal silicas having different average particle diameters in the proportion, by weight, of 1 part of silica having an average diameter of 50 nm or smaller and 0.3 to 2.0 parts of silica particles having an average diameter no more than 40% of the larger sized silica particles is used in the present invention. When fumed colloidal silica is employed as the largest sized colloidal silica, it is preferred that the colloidal silicas be present in the proportion, by weight, of 1 part of fumed colloidal silica and 1 to 2.0 parts of silica particles having an average diameter no more than 40% of the larger sized fumed colloidal silica particles. If fumed colloidal silica is not used, it is preferred that the mixture of silicas have different average particle diameters in the proportion, by weight, of 1 part of silica having an average diameter of 50 nm or smaller and 0.3 to 1 part of silica particles having an average diameter no more than 40% of the larger sized silica particles.

The colloidal silicas used in the present invention are produced commercially and are an aqueous colloidal dispersion of sub-micron sized silica particles in the form of tiny spheres of a specified average diameter. Preferably, the colloidal silicas are aqueous alkaline dispersions, e.g., ammonia stabilized colloidal silica. The fumed colloidal silicas used in the present invention are aqueous dispersions of fumed colloidal silica commercially available under the name Cab-O-Sperse® from Cabot Corporation, Cab-O-Sil Division, Tuscola, Ill. Colloidal silicas and fumed colloidal silicas low in sodium content are preferred since sodium can cause corrosion of the thermal printhead.

The binders which can be used in the topcoats of the present invention include both water-soluble and water-insoluble binders. Poor adhesion between the topcoat layer and the polyvinylbutyral color-forming layers has been a problem when a water-soluble binder is used in the absence of the compound containing at least two epoxide moieties.

A single binder or a combination of one or more binders can be employed in the topcoats.

Examples of water-insoluble binders for use in the topcoats of the present invention include aliphatic polyurethanes, styrene-maleic anhydride copolymers, polyacrylic acid, polyacrylic latex emulsions, polyvinylidene chloride copolymer emulsions and styrene-butadiene copolymer emulsions. Examples of water-soluble binders suitable for use in the topcoats include polyvinylalcohol, polyacrylamide, hydroxyethylcellulose, gelatin and starch.

To prevent interaction of the components in the topcoat layer with those in the solvent soluble color-forming layer beneath it, and to ameliorate the environmental concerns associated with coating from solvents, the topcoats of this invention are preferably coated out of aqueous systems. If the binders employed are water-insoluble, they are either coated as latex emulsions or they are made water soluble by mixing with alkali, preferably aqueous ammonia which is lost upon drying.

The ratio of total silica to compound containing at least two epoxide moieties and binder combined, by weight, is preferably in the range of 2:1 to 15:1, and is more preferably 2.5:1 to 5:1. If the ratio is smaller than 2:1, there is too little silica present so that some sticking may occur. However, if the ratio exceeds about 15:1, the integrity of the film tends to be compromised, e.g. crazing and/or cracking of the film may occur.

The coating amount of the protective topcoat layer is in the range of about 100 to 400 mg/ft$^2$.

The protective topcoat preferably contains at least one lubricant, e.g. a wax, a polymeric fluorocarbon such as polytetrafluoroethylene or a metal soap. The preferred lubricant is a polymeric fluorocarbon, e.g. polytetrafluoroethylene. The presence of a lubricant imparts slip characteristics to the thermographic recording film and helps to reduce gouging of the recording film.

The protective topcoat may contain other additives provided the additives do not hinder the anti-stick function of the topcoat layer, do not damage the thermal printhead or other wise impair image quality. Such additives include surfactants, preferably nonionic surfactants and more preferably nonionic fluorosurfactants; plasticizers; anti-static agents; and ultraviolet absorbers.

The compound containing at least two epoxide moieties may be any compound containing at least two epoxide groups (also referred to herein as a "multiepoxy compound") provided that the multiepoxy compound is water soluble or water dispersible. Multiepoxy compounds found to be particularly useful in the present invention are diepoxy crosslinking compounds. Examples of suitable diepoxy crosslinking compounds include cycloaliphatic epoxides, e.g., 3,4-epoxycyclohexylmethyl-3,4-epoxycyclohexanecarboxylate, vinyl cyclohexene dioxide, 2-(3,4-epoxycyclohexyl-5,5-spiro-3,4-epoxy)cyclohexane-metadioxane and bis(3,4epoxycyclohexyl)adipate; 1,4-butanediol diglycidyl ether; 1,2,5,6-diepoxycyclooctane; and 1,2,7,8-diepoxyoctane.

When present in the topcoats or in a separate layer on top of the topcoats of the recording films of the present invention, the multiepoxy compounds may be crosslinking with the binder and/or the silica and/or they may be reacting with themselves.

The multiepoxy compound may be present in the topcoat layer itself, it may be present as a separate layer on top of the topcoat layer or it may be present in both the topcoat layer and as a separate layer on top of the topcoat layer. Where a multiepoxy compound is present in both the topcoat and as a separate layer on top of the topcoat layer, two different multiepoxy compounds may be used, however, it is preferred that the same multiepoxy compound be used in both layers.

The presence of the multiepoxy compound in either layer results in a stronger, more robust topcoat without any substantial impact on the level of haze. The strengthened topcoat results in decreased gouging and enhanced reduction of head build-up. The reduction in head build-up is particularly advantageous when a lubricant is employed in the topcoat. The presence of a lubricant, while often desirable to impart slip characteristics and to decrease gouging, generally increases head build-up. As mentioned earlier, head build-up can cause streaking in the printed image, density degradation over time with continued printing and damage to the thermal printhead. In addition to the above, the presence of the multiepoxy compound provides for both a water and fingerprint resistant film surface.

When the multiepoxy compound is present in both the topcoat layer and in a layer on top of the topcoat, there is generally a more pronounced reduction in head build-up than when the multiepoxy compound is present in only one layer.

When the multiepoxy compound is added in the topcoat layer, the amount employed is calculated to yield, after drying, a coated coverage in the range of 10–40 mg/ft$^2$, and preferably 15–35 mg/ft$^2$ Where the multiepoxy compound is added as a separate layer on top of the topcoat layer, it is added as an aqueous solution or an aqueous dispersion and the amount of multiepoxy compound employed is calculated to yield, after drying, a coated coverage in the range of 5–20 mg/ft$^2$, preferably 10 mg/ft$^2$. Generally, a surfactant is added to the aqueous solution or dispersion of the multiepoxy compound to be coated over the topcoat layer. The amount of surfactant used is added in an amount calculated to yield, after drying, a coated coverage of 2–5 mg/ft$^2$.

A preferred topcoat of the present invention comprises a mixture of two different sized colloidal silica particles wherein the largest sized colloidal silica is a fumed colloidal silica having an average particle diameter in the range of 14–30 nm, preferably 14–15 nm and the smaller sized colloidal silica has an average particle diameter of 4 or 5 nm, a diepoxy crosslinking compound added in an amount calculated to yield, after drying, a coated coverage of 15–35 mg/ft$^2$, a lubricant, preferably polytetrafluorethylene, and a water-insoluble binder.

Fumed colloidal silica has been found to be particularly preferred in thermographic recording films which are imaged with high energy thermal printers such as Model TDU 850 commercially available from Raytheon Company, Submarine Signal Division, Portsmouth, R.I. and Model BX 500 commercially available from Seikosha America, Inc., Mahwah, N.J.

The present invention is illustrated by the following specific examples. Examples 1–15 represent recording elements prepared by coating various topcoat formulations according to the present invention over the identical imaging system. Examples 16–17 represent comparative topcoat formulations, which do not contain a multiepoxy compound in or on the topcoat, coated over the same imaging system employed in Examples 1–15.

The imaging system employed in each of the examples was prepared by coating Layer One onto a transparent 2.65 mil polyethylene terephthalate substrate pretreated with a solvent adherable subcoat (ICI 505, commercially available from ICI Americas, Inc., Wilmington, Del.) by the slot method, followed by air drying. Layer Two was then coated on top of Layer One in the same manner and air dried. It will be appreciated that while slot coating was employed, any appropriate coating method could be used, e.g. spray, air knife, gravure, silkscreen or reverse roll. Both Layer One and Layer Two were coated from a solvent mixture comprised of 80% of methyl ethyl ketone and 20% of methyl propyl ketone. The amounts of components used in each of the layers were calculated to give, after drying, the indicated coated coverages.

| | Coverage (mg/ft$^2$) |
|---|---|
| Layer One: | |
| Polyvinylbutyral (Butvar B-72, available from Monsanto, St. Louis, Mo.) | 386 |
| 3,5-Dihydroxybenzoic acid | 80 |
| Layer Two: | |
| Polyvinylbutyral (Butvar B-76, available from Monsanto, St. Louis, Mo.) | 475 |
| *Silver behenate dispersion | 156 (as silver behenate) |
| Blue Dye Precursor | 1 |
| Red Dye Precursor | 2 |
| Black Dye Precursor | 50 |

Blue Dye Precursor

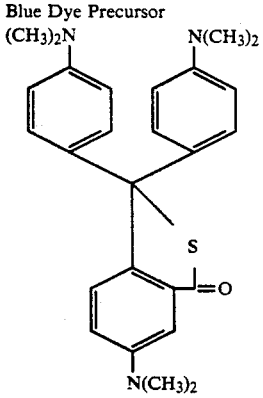

Red Dye Precursor

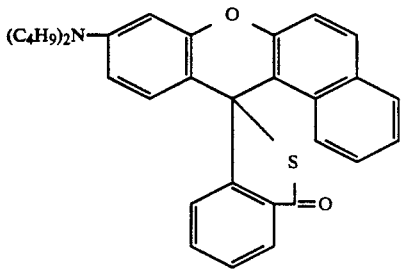

Black Dye Precursor

-continued

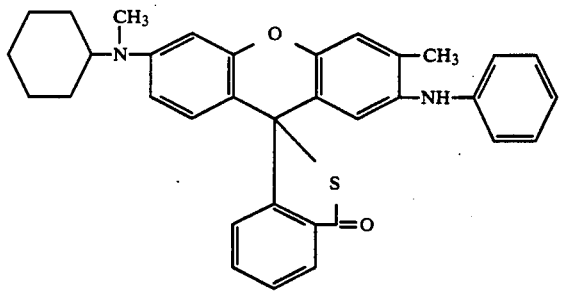

*The silver behenate dispersion was prepared according to the procedure described on page 29 of the aforementioned European Patent No. 250,558 of E. J. Dombrowski, Jr. et al.

Each of the following Examples describes a topcoat formulaton which was prepared and coated, either as an aqueous dispersion or as an aqueous solution, over the above described imaging system. The amount of components used in each topcoat formulation were calculated to give the indicated coated coverages.

EXAMPLE 1

| | Coverage (mg/ft$^2$) |
|---|---|
| NeoRez R966 Polyurethane Latex (33% total solids (TS), available from ICI Resins, Wilmington, MA) | 25.0 |
| Cab-0-Sperse A205 (a fumed colloidal silica having an average particle diameter of 14 nm, available from Cabot Corporation, Cab-0-Sil Division, Tuscola, IL) | 80.0 |
| Nalco 2326, 5 nm Silica dispersion (17% TS, available from Nalco Chemical Co.) | 80.0 |
| Hostaflon 5032, polytetrafluoroethylene dispersion, (60% TS, available from Hoechst-Celanese, Chatham, NJ) | 0.5 |
| Zonyl FSN, perfluoroalkyl polyethylene oxide non-ionic surfactant available from DuPont, Wilmington, DE) | 5.0 |
| 1,4-Butanediol diglycidyl ether (commercially available as Araldite DY 026 SP from Ciba-Geigy Limited (Plastics Division). | 20.0 |

EXAMPLE 2

| | Coverage (mg/ft$^2$) |
|---|---|
| NeoRez R966 Polyurethane Latex | 35.0 |
| Cab-0-Sperse A205, fumed colloidal silica | 65.0 |
| Nalco 2326, 5 nm Silica dispersion | 90.0 |
| Hostaflon 5032, polytetrafluoroethylene dispersion | 0.5 |
| Zonyl FSN | 5.0 |
| 1,4-Butanediol diglycidyl ether | 25.0 |

EXAMPLE 3

| | Coverage (mg/ft$^2$) |
|---|---|
| NeoRez R966 Polyurethane Latex | 38.4 |
| Cab-0-Sperse A205, fumed colloidal silica | 71.3 |
| Nalco 2326, 5 nm Silica dispersion | 98.7 |
| Hostaflon 5032, polytetrafluoroethylene dispersion | 5.5 |
| Zonyl FSN | 5.5 |

-continued

| | Coverage (mg/ft$^2$) |
|---|---|
| 1,4-Butanediol diglycidyl ether | 27.4 |

EXAMPLE 4

| | Coverage (mg/ft$^2$) |
|---|---|
| NeoRez R966 Polyurethane Latex | 25.0 |
| Cab-0-Sperse A205, fumed colloidal silica | 80.0 |
| Nalco 2326, 5 nm Silica dispersion | 80.0 |
| Zonyl FSN | 5.0 |
| 1,4-Butanediol diglycidyl ether | 20.0 |

EXAMPLE 5

A recording element was prepared according to example 4, above, and was subsequently coated with an aqueous mixture of 1,4-butanediol diglycidyl ether and Zonyl FSN. The amounts of each component used were calculated to give the indicated coated coverages after drying at 145° F. (~63° C.) for 3 minutes:

| | Coverage (mg/ft$^2$) |
|---|---|
| 1,4-Butanediol diglycidyl ether | 10 |
| Zonyl FSN | 3 |

EXAMPLE 6

| | Coverage (mg/ft$^2$) |
|---|---|
| NeoRez R966 Polyurethane Latex | 25.0 |
| Cab-0-Sperse A205, fumed colloidal silica | 80.0 |
| Nalco 2326, 5 nm Silica dispersion | 80.0 |
| Zonyl FSN | 5.0 |

the above prepared recording element was subsequently coated with an aqueous mixture of 1,4-butanediol diglycidyl ether and Zonyl FSN as described in Example 5.

EXAMPLE 7

| | Coverage (mg/ft$^2$) |
|---|---|
| NeoRez R966 Polyurethane Latex | 25.0 |
| Cab-0-Sperse A205, fumed colloidal silica | 65.0 |
| Nalco 2326, 5 nm Silica dispersion | 90.0 |
| Hostaflon 5032, polytetra-fluoroethylene dispersion | 0.5 |
| Zonyl FSN | 5.0 |
| 1,4-Butanediol diglycidyl ether | 10.0 |

EXAMPLE 8

| | Coverage (mg/ft$^2$) |
|---|---|
| NeoRez R966 Polyurethane Latex | 30.0 |
| Cab-0-Sperse A205, fumed colloidal silica | 96.0 |
| Nalco 2326, 5 nm Silica dispersion | 96.0 |
| Zonyl FSN | 6.0 |
| 1,4-Butanediol diglycidyl ether | 24.0 |

The above prepared recording element was subsequently coated with an aqueous mixture of 1,4-butanediol diglycidyl ether and Zonyl FSN as described in Example 5.

| | Coverage (mg/ft$^2$) |
|---|---|
| Polyvinyl alcohol, Vinol 350 (available from Monsanto, St. Louis, Mo.) | 25.0 |
| Cab-0-Sperse A205, fumed colloidal silica | 65.0 |
| Nalco 2326, 5 nm Silica dispersion | 90.0 |
| Zonyl FSN | 5.0 |
| 1,4-Butanediol diglycidyl ether | 20.0 |

EXAMPLE 10

| | Coverage (mg/ft$^2$) |
|---|---|
| NeoRez R966 Polyurethane Latex | 35.0 |
| Cab-0-Sperse A205, fumed colloidal silica | 65.0 |
| Nalco 2326, 5 nm Silica dispersion | 90.0 |
| Hostaflon 5032, polytetra-fluoroethylene dispersion | 0.5 |
| Zonyl FSN | 5.0 |
| Bis(3,4-epoxycyclohexyl)adipate (commercially available from Union Carbide Corp., Danbury, CT) | 25.0 |

EXAMPLE 11

A recording element was prepared according to example 9, above, and was subsequently coated with an aqueous mixture of 1,4-butanediol diglycidyl ether and Zonyl FSN as described in Example 5.

EXAMPLE 12

| | Coverage (mg/ft$^2$) |
|---|---|
| NeoRez R966 Polyurethane Latex | 25.0 |
| Cab-0-Sperse A205, fumed colloidal silica | 65.0 |
| Nalco 2326, 5 nm Silica dispersion | 90.0 |
| Hostaflon 5032, polytetra-fluoroethylene dispersion | 1.0 |
| Zonyl FSN | 5.0 |
| 1,4-Butanediol diglycidyl ether | 10.0 |

EXAMPLE 13

A recording element was prepared according to example 11, above, and was subsequently coated with an aqueous mixture of 1,4-butanediol diglycidyl ether and Zonyl FSN as described in Example 5.

EXAMPLE 14

| | Coverage (mg/ft$^2$) |
|---|---|
| Cab-0-Sperse A205, fumed colloidal silica | 80.0 |
| Nalco 2326, 5 nm Silica dispersion | 80.0 |
| Hostaflon 5032, polytetra-fluoroethylene dispersion | 0.5 |
| Zonyl FSN | 5.0 |
| 1,4-Butanediol diglycidyl ether | 20.0 |

EXAMPLE 15

| | Coverage (mg/ft$^2$) |
|---|---|
| NeoRez R966 Polyurethane Latex | 25.0 |
| Cab-0-Sperse A205, fumed colloidal silica | 65.0 |
| Nalco 2326, 5 nm Silica dispersion | 90.0 |
| Hostaflon 5032, polytetra-fluoroethylene dispersion | 0.5 |
| Zonyl FSN | 5.0 |

The above prepared recording element was subsequently coated with an aqueous mixture of 1,4-butanediol diglycidyl ether and Zonyl FSN as described in Example 5.

COMPARATIVE EXAMPLE 16

| | Coverage (mg/ft$^2$) |
|---|---|
| NeoRez R966 Polyurethane Latex | 25.0 |
| Cab-O-Sperse A205, fumed colloidal silica | 65.0 |
| Nalco 2326, 5 nm Silica dispersion | 90.0 |
| Hostaflon 5032, polytetrafluoroethylene dispersion | 0.5 |
| Zonyl FSN | 5.0 |

COMPARATIVE EXAMPLE 17

| | Coverage (mg/ft$^2$) |
|---|---|
| NeoRez R966 Polyurethane Latex | 25.0 |
| Cab-O-Sperse A205, fumed colloidal silica | 80.0 |
| Nalco 2326, 5 nm Silica dispersion | 80.0 |
| Zonyl FSN | 5.0 |

Each of the recording elements prepared above, except for the one prepared in Example 3, were imaged by means of a Model TDU 850 direct thermal printer, commercially available from Raytheon Company, Submarine Signal Division, Portsmouth, R.I. Example 3 was imaged with a Model BX 500 direct thermal printer, commercially available from Seikosha America, Inc., Mahwah, N.J. When using a Model BX 500 printer to image, the thermographic recording media of the present invention preferably include a lubricant in the topcoat in amount to give a coated coverage after drying of 4.0 to 6.0 mg/ft$^2$. When using other high energy printers, e.g., the Model TDU 850, a lesser amount of lubricant, i.e. 0.25 to 1.0 mg/ft$^2$, is generally employed.

The streaking, % haze, the amount of gouging and the head build-up were determined for each imaged film. The results are recorded in Table 1.

The haze measurements were determined using a Spectrogard II Spectrophotometer made by Gardner-Neotec Instruments, Silver Spring, Md.

Streaking, gouging and head build-up were each ascertained visually.

For streaking, "excellent" describes those recording films for which there was no observable streaking after 50 feet of printing; "very good" describes those recording films for which there was only slight, but noticeable streaking after 50 feet of printing; "good" describes recording films for which there was moderate streaking visible after 50 feet of printing; "fair" is used to describe those recording films for which there was heavy streaking before 50 feet of printing accompanied by significant density loss; and, "poor" describes those recording films for which streaking was so severe that 50 feet of recording film could not be successfully printed—the heating elements were insulated to an extent which seriously interfered with printing.

For gouging, "excellent" describes those recording films for which there was no observable gouging after 50 feet of printing; "fair" describes those recording films for which infrequent gouging was observed in the high density areas of the images; and, "poor" describes those recording films for which severe gouging was observable at the onset of printing.

For head build-up, "excellent" describes those situations in which there was only very slight if any head build-up on the thermal printhead after 50 feet of printing; "good" describes those situations where there was a slight to moderate accumulation of material on and/or after the print elements after 50 feet of printing; "fair" describes those situations for which there was substantial accumulation of material on and/or after the print elements after 50 feet of printing; and, "poor" describes those situations in which there was an exorbitant amount of material directly on and after the print elements.

TABLE I

| EXAMPLE | % HAZE | STREAKING | GOUGING | HEAD BUILD-UP |
|---|---|---|---|---|
| 1 | 8.2 | very good | excellent | excellent |
| 2 | 8.7 | very good | excellent | excellent |
| 3 | 4.8 | excellent | excellent | good |
| 4 | 7.0 | very good | fair | good |
| 5 | 6.9 | excellent | fair | excellent |
| 6 | 8.2 | good | fair | good |
| 7 | 5.9 | very good | excellent | good |
| 8 | 8.0 | very good | fair | excellent |
| 9 | 24.7 | excellent | excellent | excellent |
| 10 | 8.2 | very good | excellent | good |
| 11 | 4.5 | excellent | excellent | excellent |
| 12 | 4.8 | fair | excellent | fair |
| 13 | 4.5 | good | excellent | fair |
| 14 | 17.0 | good | excellent | good |
| 15 | 5.6 | fair | excellent | fair |
| | | Comparative Examples | | |
| 16 | 5.8 | fair | excellent | poor |
| 17 | 8.3 | poor | poor | poor |

The level of haze in examples 9 and 14 is noted as being relatively higher than that reported for the other examples. The high level of haze in example 9 is believed to be due to crosslinked polyvinylalcohol coming out of solution during the drying process when the film was formed. The high level of haze in example 14 is attributed to the absence of binder in the topcoat.

As can be seen from the results shown in Table 1, the thermographic recording films of Examples 1–15 according to the present invention were superior in terms of gouging (for those recording films which did not contain any lubricant), head build-up, and streaking to comparative Examples 16–17 which did not contain a diepoxy crosslinking compound in the topcoat layer and/or in a layer on top of the topcoat layer.

To further illustrate the present invention, recording films prepared as in Examples 2, 4, 5 and 6 were continuously imaged with a test pattern having an eight-step gray tone scale. Measurements of the optical transmission density (O.D.) of each of the gray steps were made. Tables 2–5 show the initial density of each of the gray steps, the density of the gray steps after imaging 50 feet of recording film and the difference between the two measurements(O.D. Δ) for each of examples 2, 4, 5 and 6 respectively. The densities reported after 50 feet of printing were obtained after continuously printing for 50 feet, stopping, allowing the printer to cool for 10 minutes, restarting the printing and measuring the resulting transmission density. This was done to compensate for any density loss attributable to the thermal printer. The built-in electronics of the thermal printhead do not sufficiently compensate for heat build-up in the head itself and consequently some density loss tends to occur upon continued printing, independent of the particular thermographic recording film.

As a control, the experiment was repeated using a recording film prepared according to comparative example 16; the results are reported in Table 6.

TABLE 2

| Step | Initial O.D. | O.D. 50 ft | O.D. Δ |
|---|---|---|---|
| | Example 2 | | |
| 1 | 0.28 | 0.29 | −0.01 |
| 2 | 0.35 | 0.35 | 0.00 |
| 3 | 0.42 | 0.44 | −0.02 |
| 4 | 0.48 | 0.46 | 0.02 |
| 5 | 0.54 | 0.55 | −0.01 |
| 6 | 0.71 | 0.69 | 0.02 |
| 7 | 0.92 | 0.95 | −0.03 |
| 8 | 1.76 | 1.79 | −0.03 |

TABLE 3

| Step | Initial O.D. | O.D. 50 ft | O.D. Δ |
|---|---|---|---|
| | Example 4 | | |
| 1 | 0.33 | 0.32 | 0.01 |
| 2 | 0.40 | 0.42 | −0.02 |
| 3 | 0.50 | 0.50 | 0.00 |
| 4 | 0.57 | 0.56 | 0.01 |
| 5 | 0.65 | 0.66 | −0.01 |
| 6 | 0.78 | 0.78 | 0.00 |
| 7 | 1.01 | 1.01 | 0.00 |
| 8 | 1.84 | 1.85 | −0.01 |

TABLE 4

| Step | Initial O.D. | O.D. 50 ft | O.D. Δ |
|---|---|---|---|
| | Example 5 | | |
| 1 | 0.32 | 0.32 | 0.00 |
| 2 | 0.40 | 0.41 | −0.01 |
| 3 | 0.49 | 0.48 | 0.01 |
| 4 | 0.56 | 0.54 | 0.02 |
| 5 | 0.66 | 0.65 | 0.01 |
| 6 | 0.80 | 0.79 | 0.01 |
| 7 | 1.03 | 1.00 | 0.03 |
| 8 | 1.83 | 1.81 | 0.02 |

TABLE 5

| Step | Initial O.D. | O.D. 50 ft | O.D. Δ |
|---|---|---|---|
| | Example 7 | | |
| 1 | 0.29 | 0.19 | 0.10 |
| 2 | 0.35 | 0.26 | 0.09 |
| 3 | 0.46 | 0.35 | 0.11 |
| 4 | 0.50 | 0.39 | 0.11 |
| 5 | 0.64 | 0.55 | 0.09 |
| 6 | 0.74 | 0.68 | 0.06 |
| 7 | 0.99 | 0.92 | 0.07 |
| 8 | 1.84 | 1.79 | 0.05 |

TABLE 6

| Step | Initial O.D. | O.D. 50 ft | O.D. Δ |
|---|---|---|---|
| | Comparative Example 16 | | |
| 1 | 0.14 | 0.05 | 0.09 |
| 2 | 0.20 | 0.10 | 0.10 |
| 3 | 0.27 | 0.12 | 0.15 |
| 4 | 0.31 | 0.14 | 0.17 |
| 5 | 0.44 | 0.20 | 0.24 |
| 6 | 0.57 | 0.39 | 0.18 |
| 7 | 0.78 | 0.55 | 0.23 |
| 8 | 1.44 | 1.28 | 0.16 |

As can be seen from the foregoing data, the recording films of the present invention which contain a multiepoxy compound in the topcoat and/or in a layer on top of the topcoat, decrease the density degradation which may occur over time with continued printing. It is noted that example 7, which had only 10 mg/ft$^2$ of 1,4-butanediol diglycidyl ether in the topcoat, showed some density degradation with continued printing. However, the density loss was less than that observed in comparative example 16, which contained no multiepoxy compound in the topcoat. Since certain changes may be made in the above subject matter without departing from the spirit and scope of the invention herein involved, it is intended that all matter contained in the above description and the accompanying examples be interpreted as illustrative and not in any limiting sense.

We claim:

1. A thermographic recording film comprising a support carrying:

(a) a dye image-forming system comprising a di- or triarylmethane thiolactone dye precursor, an organic silver salt, a heat-fusible organic acidic material, and a polymeric binder; and, (b) a protective topcoat layer positioned above said dye image-forming system and comprising a mixture of at least two colloidal silicas having different average particle diameters in the proportion, by weight, of 1 part of silica having an average diameter of 50 nm or smaller and 0.3 to 2.0 parts of silica particles having an average diameter no more than 40% of the larger sized silica particles, said thermographic recording film additionally including a compound containing at least two epoxide moieties in the protective topcoat layer and/or in a layer on top of said protective topcoat layer, the ratio of total silica to said compound containing at least two epoxide moieties being at least 2:1 by weight.

2. A thermographic recording film according to claim 1 which additionally includes a binder in said topcoat layer.

3. A thermographic recording film according to claim 2 wherein said topcoat binder is a water-insoluble binder.

4. A thermographic recording film according to claim 3 wherein said water-insoluble binder is an aliphatic polyurethane.

5. A thermographic recording film according to claim 2 wherein said topcoat binder is a water-soluble binder.

6. A thermographic recording film according to claim 5 wherein said water-soluble binder is polyvinylalcohol.

7. A thermographic recording film according to claim 2 wherein the ratio of said silica to said binder and said compound containing at least two epoxide moieties is 2.5:1 to 5:1.

8. A thermographic recording film according to claim 2 wherein said topcoat further comprises a second binder.

9. A thermographic recording film according to claim 1 wherein said compound containing at least two epoxide moieties is a diepoxy crosslinking compound.

10. A thermographic recording film according to claim 9 wherein said diepoxy crosslinking compound is 1,4-butanediol diglycidyl ether.

11. A thermographic recording film according to claim 9 wherein said diepoxy crosslinking compound is bis(3,4-epoxycyclohexyl)adipate.

12. A thermographic recording film according to claim 1 wherein said compound containing at least two epoxide moieties is present in said topcoat layer.

13. A thermographic recording film according to claim 12 which additionally includes a compound containing at least two epoxide moieties in a layer on top of said topcoat layer.

14. A thermographic recording film according to claim 1 wherein said compound containing at least two epoxide moieties is present in a layer on top of said topcoat layer.

15. A thermographic recording film according to claim 1 wherein one of said colloidal silicas is a fumed colloidal silica having an average particle diameter in the range of 14 nm to 30 nm.

16. A thermographic recording film according to claim 1 comprised of 2 colloidal silicas wherein one of said colloidal silicas is fumed colloidal silica having an average diameter of 14 nm.

17. A thermographic recording film according to claim 16 wherein the second colloidal silica is a colloidal silica having an average particle diameter of 5 nm.

18. A thermographic recording film according to claim 16 wherein said organic silver salt is silver behenate.

19. A thermographic recording film according to claim 18 wherein said heat-fusible organic acidic material is 3,5-dihydroxybenzoid acid.

20. A thermographic recording film according to claim 1 wherein said organic silver salt, polyvinylbutyral and di- or triarylmethane thiolactone dye precursor are carried in one layer on said support and said heat-fusible organic acidic material is in an adjacent layer.

21. A thermographic recording film according to claim 1 wherein said protective topcoat further comprises a lubricating agent.

22. A thermographic recording film according to claim 21 wherein said lubricating agent is polytetrafluoroethylene.

23. A thermographic recording film according to claim 1 wherein the ratio of said silica to said compound containing at least two epoxide moieties is from 4:1 to 8:1.

24. A thermographic recording film according to claim 1 wherein said dye image-forming system further comprises a second heat-fusible organic acidic material.

25. A thermographic recording film according to claim 1 wherein said protective topcoat further comprises a surfactant.

26. A thermographic recording film according to claim 25 wherein said surfactant is a nonionic fluorosurfactant.

27. A thermographic recording film according to claim 1 wherein said polymeric binder is polyvinylbutyral.

28. A thermographic recording film according to claim 1 wherein said support is a transparent support.

* * * * *